US006309366B1

(12) United States Patent
Maxwell

(10) Patent No.: US 6,309,366 B1
(45) Date of Patent: Oct. 30, 2001

(54) FOOT THERAPY DEVICE

(75) Inventor: Randolph E. Maxwell, El Paso, TX (US)

(73) Assignee: Helen of Troy, El Paso, TX (US)

( * ) Notice: Subject to any disclaimer, the term of this patent is extended or adjusted under 35 U.S.C. 154(b) by 0 days.

(21) Appl. No.: 09/354,686

(22) Filed: Jul. 16, 1999

(51) Int. Cl.[7] ..... A61H 19/00

(52) U.S. Cl. ..... 601/166; 601/160; 601/158; 601/156; 601/154; 601/15; 601/22; 601/49; 601/55

(58) Field of Search ..... 601/154, 156, 601/157, 158, 159, 160, 166, 168, 15, 18, 22, 49, 55

(56) References Cited

U.S. PATENT DOCUMENTS

D. 330,426 * 10/1992 Elkerbout ..... D24/213
3,283,756 * 11/1966 Turley ..... 601/166
3,837,334 * 9/1974 Johnson ..... 601/19
3,939,825 * 2/1976 Krummenacher ..... 601/104
4,497,313 * 2/1985 Kurosawa ..... 601/16
4,620,529 * 11/1986 Kurosawa ..... 601/157

* cited by examiner

*Primary Examiner*—Michael A. Brown
*Assistant Examiner*—Benjamin K. Koo
(74) *Attorney, Agent, or Firm*—John E. Toupal; Harold G. Jarcho

(57) ABSTRACT

A foot therapy device including a portable housing with an annular wall having an upper edge and defining a reservoir for retaining a volume of liquid to be used during foot therapy; a lid covering a given portion of the reservoir and secured to a continuous portion of the upper edge; and a liquid seal member disposed between the lid and the given upper edge portion.

22 Claims, 5 Drawing Sheets

FOOT THERAPY DEVICE

BACKGROUND OF THE INVENTION

This invention relates generally to a portable foot therapy device and, more particularly, to a portable device having a reservoir in which feet can be submerged in heated liquid and subjected to massage therapy.

In the prior art there are various known foot care massages and baths which are capable of providing either a vibrating massage alone, a vibrating massage with dry heat or a vibrating massage with a liquid bath and a supplemental heater. Typical examples of such devices are disclosed in U.S. Pat. Nos. 3,283,756 and 4,513,735. However, portability of prior foot bath massage units has been cumbersome and subject to undesirable spillage of retained liquid.

The object of the invention, therefore, is to provide an improved, more easily transportable appliance having a liquid retaining reservoir for effecting foot therapy.

SUMMARY OF THE INVENTION

The invention is a foot therapy device including a portable housing with an annular wall having an upper edge and defining a reservoir for retaining a volume of liquid to be used during foot therapy; a lid covering a given portion of the reservoir and secured to a continuous portion of the upper edge; and a liquid seal provided between the lid and the given upper edge portion. The sealed lid allows the given reservoir portion to hold liquid during transport of the device.

According to one feature of the invention, the device has a handle disposed on the housing in a position horizontally spaced from the continuous upper edge portion. The handle facilitates transport of the housing with the given reservoir portion disposed below the remaining portion thereof.

According to further features of the invention, the device includes a heater for heating liquid in the reservoir, an aeration system for forcing air into a lower portion of the reservoir and a vibrator for vibrating the housing. The aeration system, heater and vibrator enhance the therapy capability of the device.

According to still other features of the invention, the housing further defines a compartment isolated from the reservoir and retaining the aeration system. The isolated compartment protects the vibrator and aeration system from liquid retained in the reservoir.

According to an additional feature of the invention, the housing includes a bottom wall with a convex portion projecting into the reservoir and having an undulating cross-section. The convex portion supports the vibrator and facilitates foot massage therapy.

According to another feature of the invention, the housing further defines a cavity disposed in a lower portion of the reservoir and retaining the heater means; and a path providing liquid communication between the cavity and the reservoir. These features facilitate desired heating of the liquid retained in the reservoir.

Also included with the device are electrical controls for controlling the aeration system, the vibrator, and the heater. The controls are disposed in the compartment and therefore protected from liquid retained in the reservoir.

According to yet another feature of the invention, the aeration system includes a liquid circulation network for circulating liquid retained in the reservoir, a pump for circulating liquid through the circulation network, and a venturi mechanism for injecting air into the circulation network. These features facilitate the injection of air into the reservoir.

According to another feature of the invention, the handle is disposed on a portion of the annular wall substantially directly opposite to the center of the continuous upper-edge portion. This feature provides a desired relative orientation of the given reservoir portion and handle.

According to yet another feature of the invention, the handle is formed by a slot in an upper portion of the annular wall, and the slot further defines a spout for emptying water out of the reservoir.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
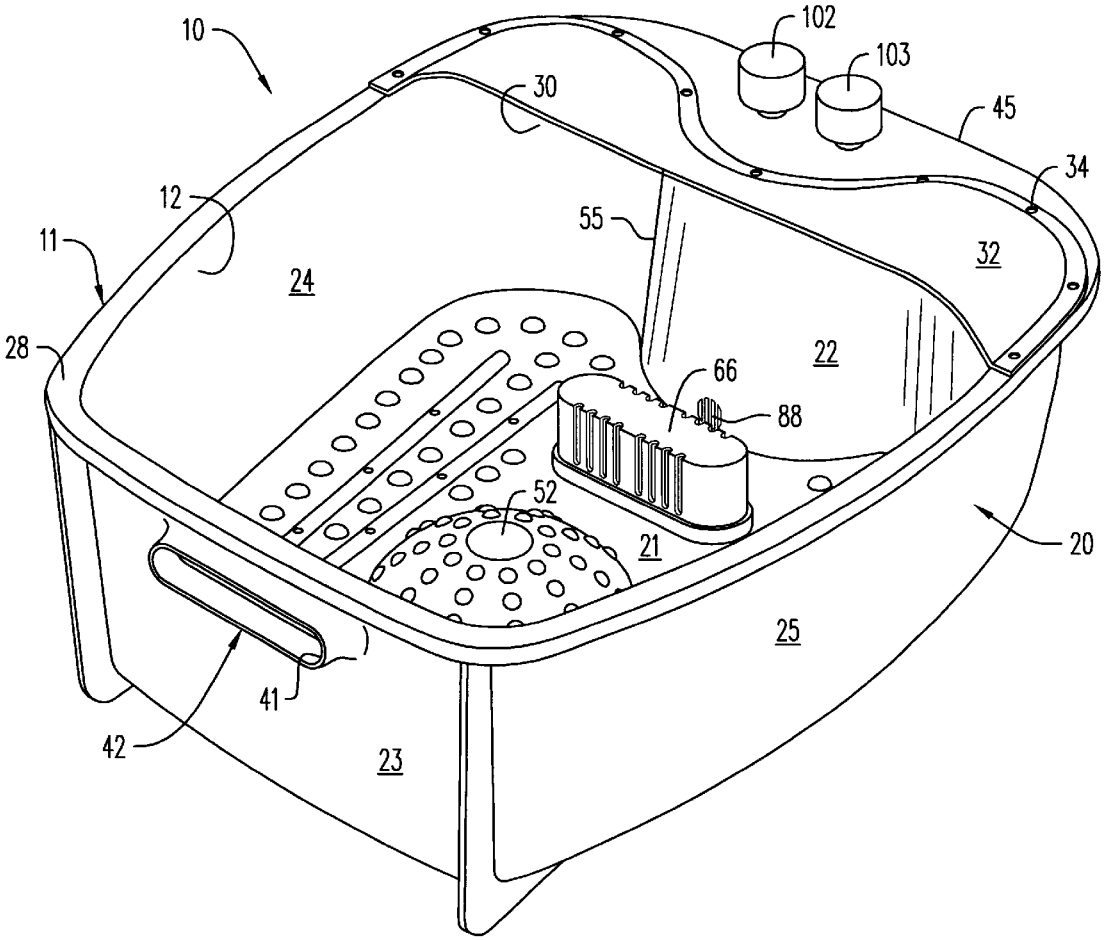
FIG. 1 is a top perspective view of a foot therapy device of the invention.
Figure 2:
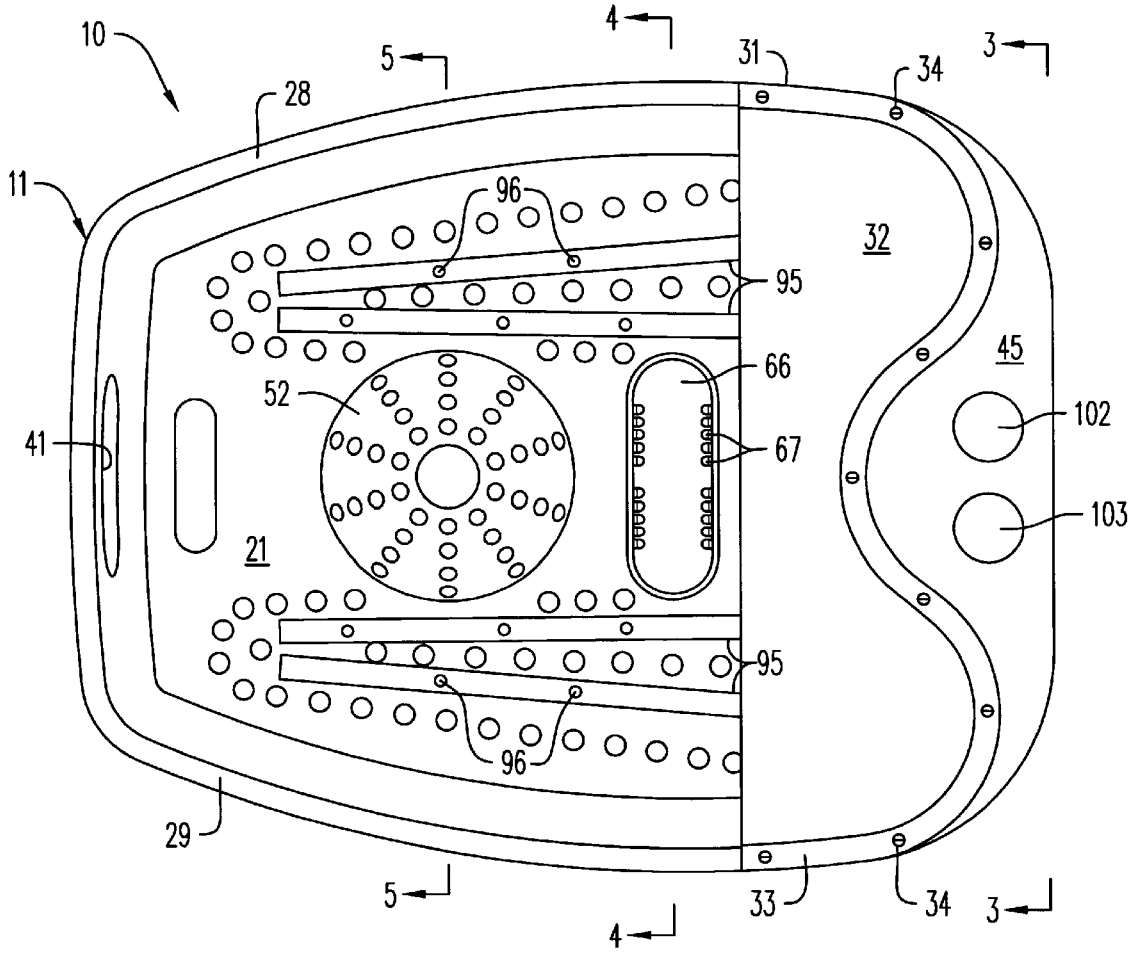
FIG. 2 is a top view of the device shown in FIG. 1.
Figure 4:
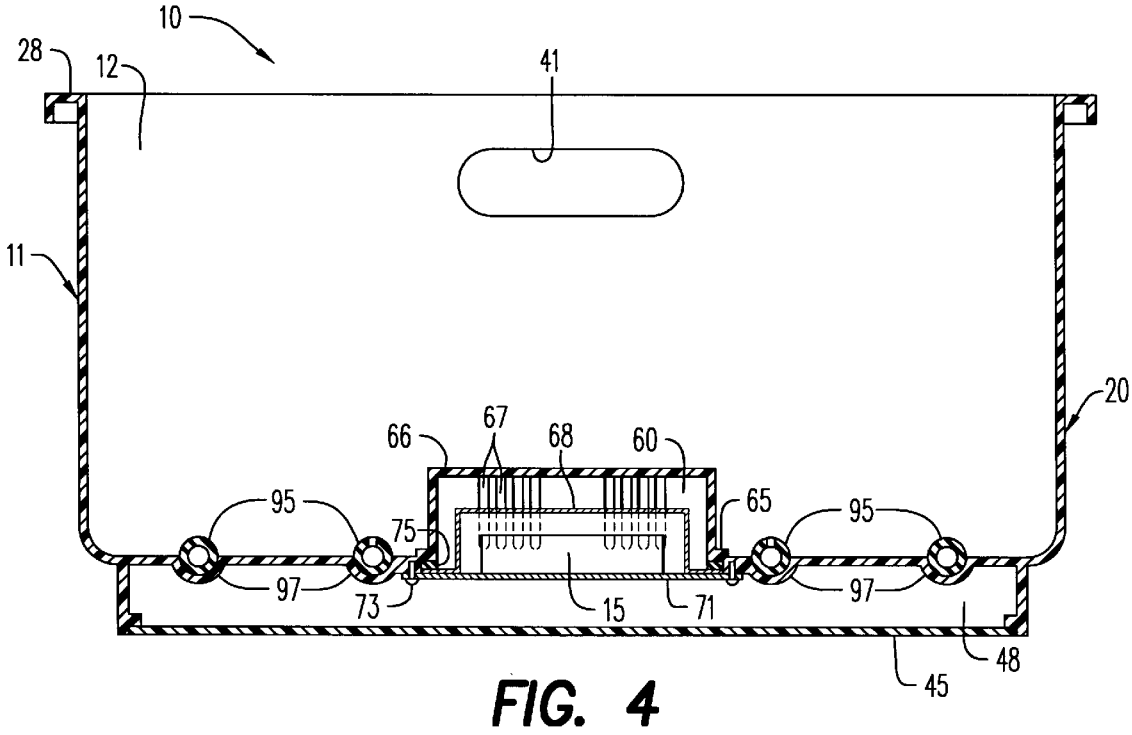
FIG. 4 is a cross-sectional view taken along lines 4—4 of FIG. 2.

A foot therapy appliance 10 includes a housing 11 which defines a reservoir 12 for liquid into which feet can be submerged for therapy treatment. The housing 11 retains a heater 15 (FIG. 4) and aeration system (FIG. 2) for, respectively, heating and aerating the water contained in the reservoir 12. Also retained by the housing 11 for producing vibrating motion thereof is a vibrator mechanism 17 shown in FIG. 5 and an electrical system for controlling the heater 15, aeration system vibrator 17.

The housing 11 has a bottom wall 21, an upwardly projecting, annular wall 20 formed by side walls 22, 23 and end walls 24, 25. Forming an upper edge 28 of the annular wall 20 is an outwardly projecting lip 29. A continuous portion 31 of the upper edge 28 terminates the end wall 22 and adjacent portions of the side walls 24 and 25. A lid 32 covers a given portion 30 of the reservoir 12 and has an outwardly projecting flange 33 secured to the lip 29 by screws 34. Disposed between the lip 29 and the flange 33 is a gasket 38 providing a liquid seal between the lid 32 and the upper edge portion 31 of the annular wall 20. A slot 41 forms a handle portion 42 at an upper end of the end wall 23 directly opposite to the center of upper edge portion 31.

The housing 11 also includes a cover 45 (FIG. 6) secured to the bottom wall 21 and the portion 31 of the upper edge 28. Formed between the cover 45 and, respectively, the bottom wall 21 and the end wall 22 is a compartment 48. A semi-spherical portion (FIG. 5) of the compartment 48 is formed between the cover 45 and a spherically convex portion 52 of the bottom wall 21. Similarly formed between the cover 45 and a cylindrically convex portion 55 of the end wall 22 is a semi-cylindrical portion of the compartment 45.

Figure 5:
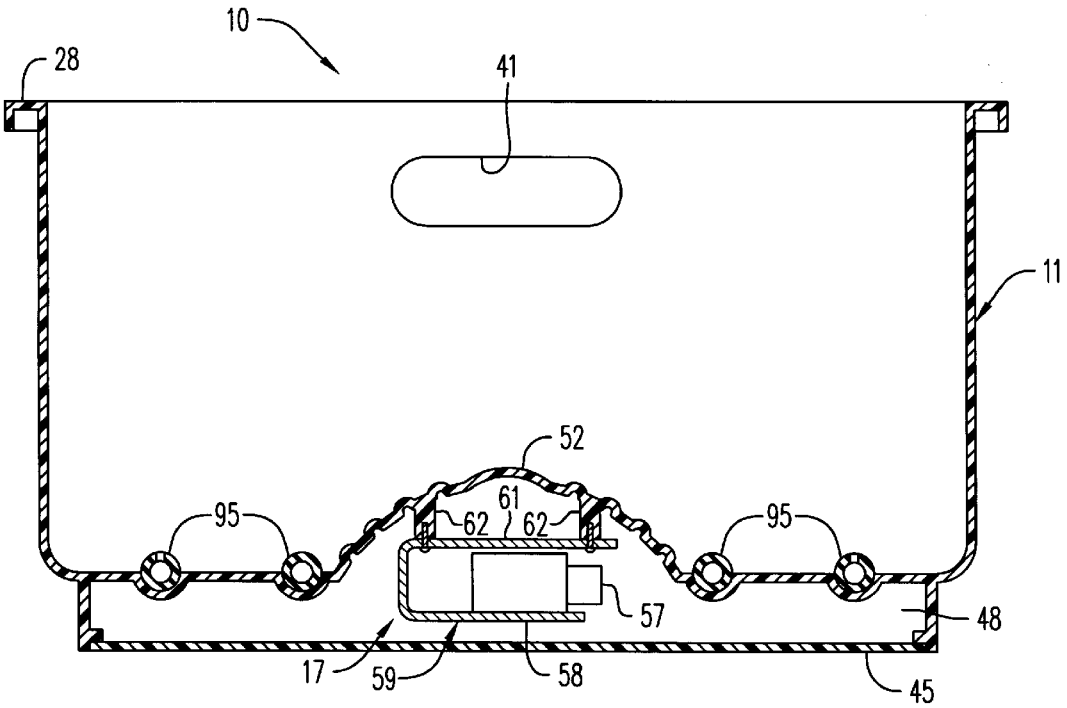
FIG. 5 is a cross-sectional view taken along lines 5—5 of FIG. 2.
Figure 6:
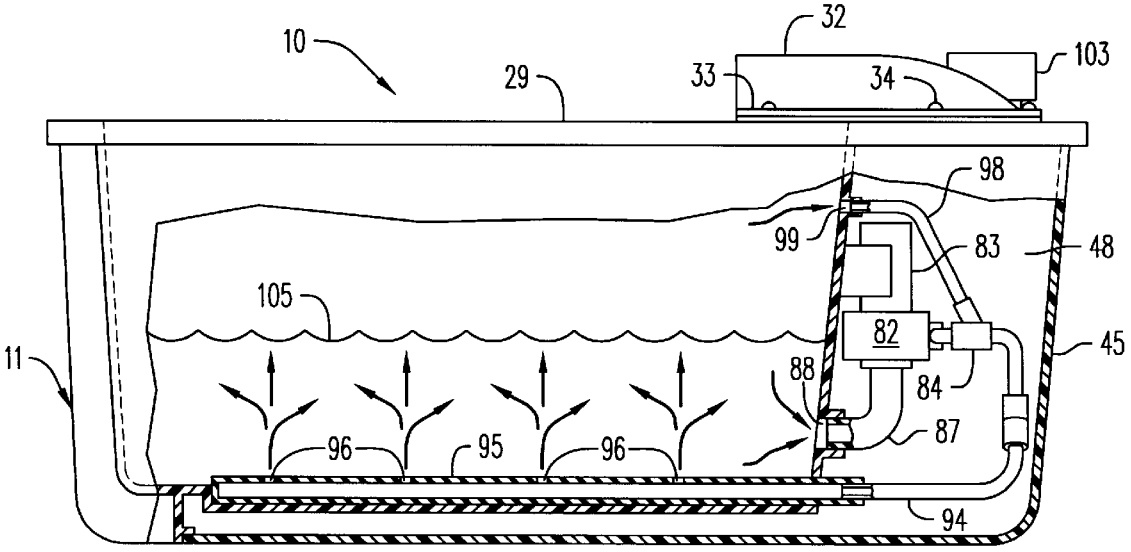
FIG. 6 is a partially broken side view of the device shown in FIGS. 1 and 2.

The semi-spherical portion 52 of the compartment 45 retains the vibrator mechanism 17. Included in the vibrator mechanism 17 is a vibrator motor 57 attached to one leg 58 of a U-shaped member 59. An opposite leg 61 of the member 59 is secured to bosses 62 extending downwardly from the convex portion 52 of the bottom wall 21. As shown in FIG. 5, the convex portion 52 has an undulating cross-section so as to enhance its vibrating motion in response to activation of the motor 57. An opening 65 in the bottom wall 21 is covered by an upwardly projecting case 66 defining a cavity 60 and having slots 67 providing communication into the reservoir 12. Closing an open bottom of the case 66 is an inverted cupshaped member 68 receiving the resistive heater coil 15 mounted on a plate 71 engaging the member 68 and secured to the bottom wall 21 by screws 73. An O-ring 75 provides a liquid seal between the member 68 and a bottom edge of the case 66.

Figure 3:
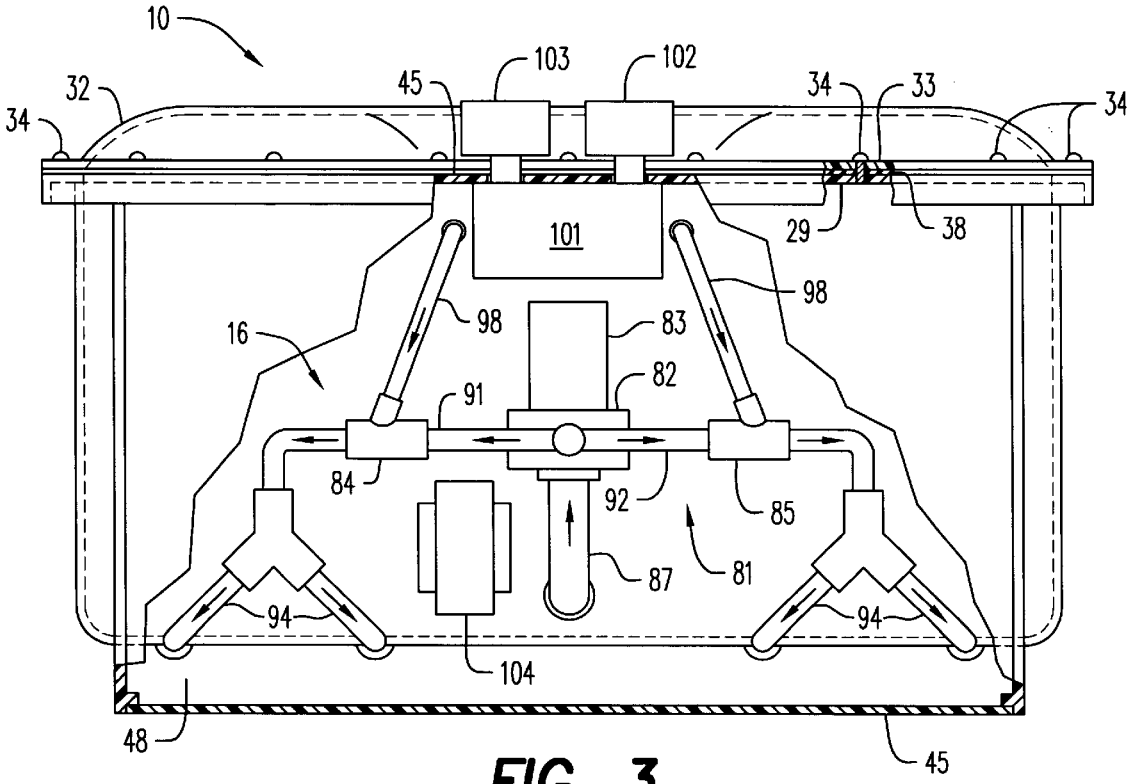
FIG. 3 is a partially broken away rear view of the device shown in FIGS. 1 and 2.

The aeration system 16 includes a liquid circulation network 81, a liquid pump 82 driven by a motor 83, and a pair of venturi mixers 84, 85, all retained in the semicylindrical portion 52 of the compartment 48 as depicted in FIG. 3. Forming the circulation network 81 are pipes 95 having outlet portions 96 opening into the reservoir 12 and supported in grooves 97 formed in the bottom wall 21; a tube 87 extending between the pump 82 and an inlet 88 at the bottom of the end wall 22; tubes 91, 92 extending between the pump 82 and, respectively, the venturi mixers 84, 85; and tubes 94 extending between the venturi mixers 84, 85 and the pipes 95. Air is provided to the venturi mixers by a pair of tubes 98 communicating with air inlet openings 99 at the top of the side wall 22.

The electrical system includes a control box 101 supported by a bottom surface of the lid 32, control knobs 102, 103 mounted on an upper surface of the lid 32 and a transformer 104 providing reduced voltage for the vibrator motor 57. In response to manual manipulation of the control knobs 102, 103, respectively, the pump 82 can be energized to produce aerated liquid flow through the circulation network 81; the heater coil 15 can be energized to heat the circulating liquid; and the vibrator motor 57 energized to induce vibrating motion of the housing 11 and, particularly, the convex portion 52 of the bottom wall 21. Accordingly, a user's feet positioned on the convex portion 52 are subjected to vibratory massage and the therapeutic action of heated, aerated liquid discharged through the outlet portions 96 in the pipes 95 supported on the bottom wall 21.

Figure 7:
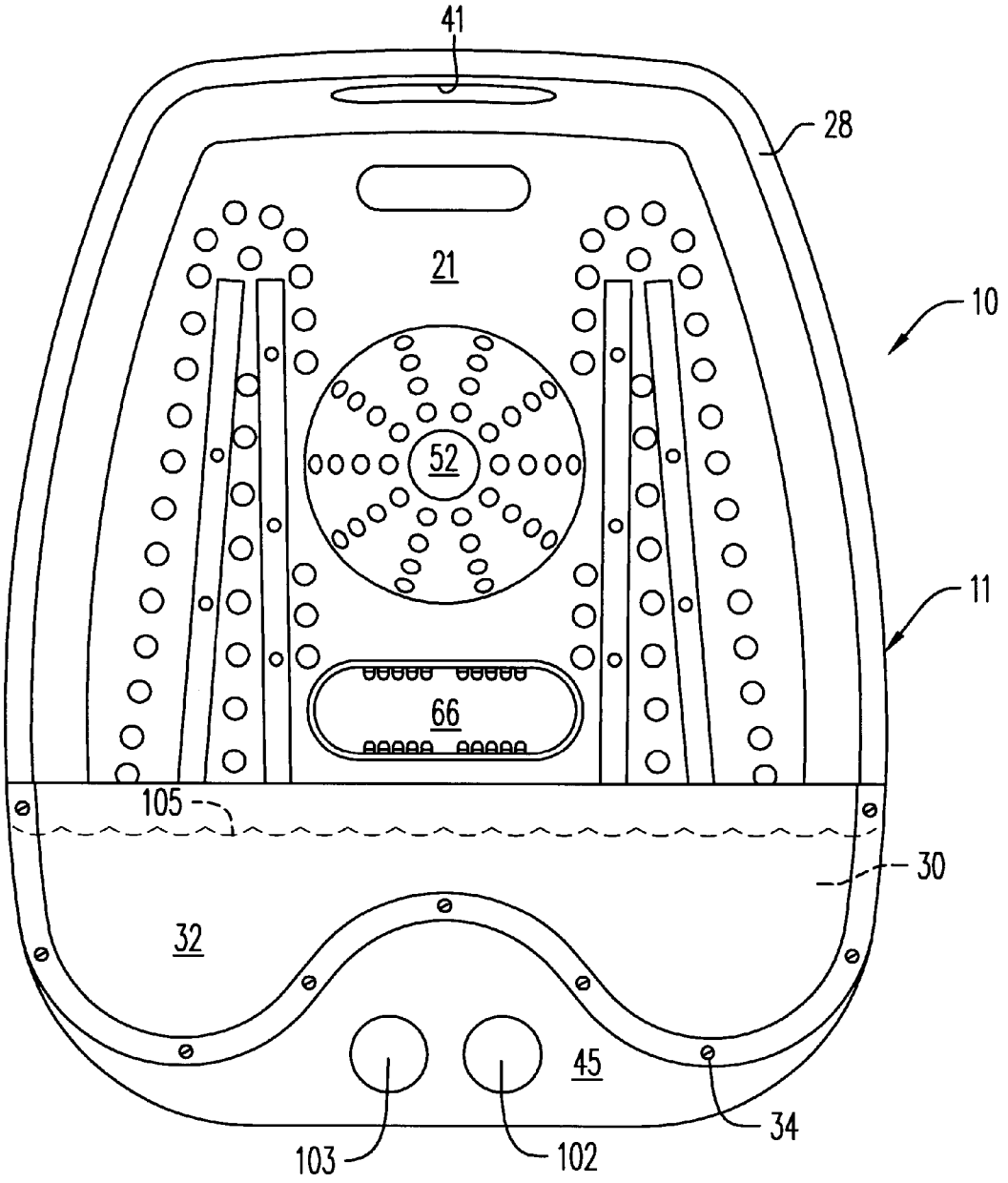
FIG. 7 is a view showing the device in a modified orientation which facilitates portability.

Use of the portable appliance 10 is simplified by the provision of the lid 32 and the handle 42. As illustrated in FIG. 7, after the reservoir 12 has been filled with a desired volume of liquid 105, the housing 11 can be oriented with the given portion 30 of the reservoir 12 positioned below the remaining portion thereof. With the housing 11 in that position, the handle 42 can be used to transport the appliance 10 to a location of desired use with a reduced risk of spillage of liquid from the reservoir 12. During such transport, the gasket sealed lid 32 prevents liquid leakage out of the given reservoir portion 30. In addition, the slotted handle 42 can function as a spout for emptying liquid from the reservoir 12 after use of the appliance 10.

Obviously, many modifications and variations of the present invention are possible in light of the above teachings. For example only, the liquid seal for the lid 32 can also be provided by suitable adhesives, ultrasonic welding of the flange 33 and lip 29 or, heat staking thereof. It is to be understood, therefore, that the invention can be practiced otherwise than as specifically described.

What is claimed is:

1. Foot therapy apparatus comprising:

a portable housing means comprising an annular wall having an upper edge and defining an upwardly open reservoir for retaining a volume of liquid for covering the feet of a person desiring foot therapy;

a detachable lid covering only a given portion of said reservoir and secured to a continuous portion of said upper edge located only along one end of said housing;

a liquid seal means disposed between said lid and said given portion of said upper edge; and handle means disposed on said housing means in a position horizontally spaced from said continuous portion of said upper edge, said handle means adapted to facilitate transport of said housing with said given portion of said reservoir filled with liquid and disposed below the remaining portion thereof.

2. An apparatus according to claim 1 wherein said handle is disposed on a portion of said annular wall directly opposite to substantially the center of said continuous portion of said upper edge.

3. An apparatus according to claim 2 wherein said handle is formed by a slot in an upper portion of said annular wall.

4. An apparatus according to claim 3 including a heater means for heating liquid in said reservoir, and aeration means for forcing air into a lower portion of said reservoir.

5. An apparatus according to claim 4 including vibrator means for vibrating said housing means.

6. An apparatus according to claim 5 wherein said housing means further comprises a bottom wall having a convex portion projecting into said given portion of said reservoir, said convex portion has an undulating cross-section, and said vibrator means is mounted on said convex portion.

7. An apparatus according to claim 5 wherein said housing means further defines a compartment isolated from said reservoir and retaining said aeration means and said vibrator means.

8. An apparatus according to claim 7 wherein said housing means further defines a cavity disposed in a lower portion of said reservoir and retaining said heater means; and a path providing liquid communication between said cavity and said reservoir.

9. An apparatus according to claim 8 including electrical control means for controlling said aeration means, said vibrator means, and said heater means; said control means being disposed in said compartment and isolated from liquid retained in said reservoir.

10. An apparatus according to claim 8 wherein said aeration means comprises a liquid circulation means for circulating liquid retained in said reservoir, a pump for pumping liquid through said circulation means, and a venturi mechanism for injecting air into said circulation means.

11. Foot therapy apparatus comprising:

a portable housing means comprising an annular side wall having an upper edge and defining a reservoir for retaining a volume of liquid for covering the feet of a person desiring foot therapy;

a cover projecting from a continuous portion of said upper edge and extending over only a given portion of said reservoir; and a handle disposed on said housing means in a position horizontally spaced from said continuous portion of said upper edge, said handle adapted to facilitate transport of said housing with only said given portion of said reservoir filled with liquid and disposed below the remaining portion of said reservoir.

12. An apparatus according to claim 10 wherein said handle is disposed on a portion of said annular wall directly opposite to substantially the center of said continuous portion of said upper edge.

13. An apparatus according to claim 12 wherein said handle is formed by a slot in an upper portion of said annular wall.

14. An apparatus according to claim 12 including a heater means for heating liquid in said reservoir, and aeration means for forcing air into a lower portion of said reservoir.

15. An apparatus according to claim 13 including vibrator means for vibrating said housing means.

16. An apparatus according to claim 14 wherein said housing means further comprises a bottom wall having a convex portion projecting into said given portion of said reservoir, said convex portion has an undulating cross-section, and said vibrator means is mounted on said convex portion.

17. An apparatus according to claim 15 wherein said housing means further defines a compartment isolated from said reservoir and retaining said aeration means and said vibrator means.

18. An apparatus according to claim 16 wherein said housing means further defines a cavity disposed in a lower portion of said reservoir and retaining said heater means; and a path providing liquid communication between said cavity and said reservoir.

19. An apparatus according to claim 17 wherein said aeration means comprises a liquid circulation means for circulating liquid retained in said reservoir, a pump for pumping liquid through said circulation means, and a venturi mechanism for injecting air into said circulation means.

20. An apparatus according to claim 3 wherein said slot further defines a spout for emptying liquid from said reservoir and a spout projecting from said wall.

21. An apparatus according to claim 13 wherein said slot further defines a spout for emptying liquid from said reservoir and a spout projecting from said wall.

22. An apparatus according to claim 11 wherein said handle is adapted to facilitate the transport of said housing with said given portion of said reservoir disposed substantially completely below said remaining portion thereof.

* * * * *